US006131923A

United States Patent [19]

Miotto

[11] Patent Number: 6,131,923

[45] Date of Patent: Oct. 17, 2000

[54] SKATE WITH SINGLE-BLADE TRUCK, PARTICULARLY WITH IN-LINE WHEELS

[75] Inventor: Sergio Miotto, Quinto, Italy

[73] Assignee: Nordica S.p.A., Trevignano, Italy

[21] Appl. No.: 08/769,172

[22] Filed: Dec. 18, 1996

[30] Foreign Application Priority Data

Dec. 22, 1995 [IT] Italy ..... TV95A0163

[51] Int. Cl.[7] ..... A63C 17/06

[52] U.S. Cl. ..... 280/11.22; 280/11.28; 301/5.3; 301/5.7; 152/11

[58] Field of Search ..... 280/11.19, 11.22, 280/11.23, 11.26, 11.27, 11.28, 843, 11.13, 10, 13; 301/5.3, 5.7; 152/5, 11, 12, 323, 393, 394

[56] References Cited

U.S. PATENT DOCUMENTS

| | | | |
|---|---|---|---|
| 55,901 | 6/1866 | Plimpton | 280/11.23 |
| 108,184 | 10/1870 | Pollitt | 280/11.27 |
| 284,009 | 8/1883 | Henry | 301/5.3 |
| 683,559 | 10/1901 | Fish | 135/77 |
| 801,263 | 10/1905 | Peard | 301/5.3 |
| 1,464,057 | 8/1923 | Bell | 135/83 |
| 1,489,197 | 4/1924 | Daverkosen | 301/5.3 |
| 2,064,690 | 12/1936 | Schavone | 301/5.3 |
| 2,166,767 | 7/1939 | Petermann | 280/11.22 |
| 3,414,280 | 12/1968 | Ohashi | 301/5.3 |
| 3,689,091 | 9/1972 | Nagin | 280/11.2 |
| 3,936,061 | 2/1976 | Wada | 280/11.23 |
| 4,153,263 | 5/1979 | Yoshimoto | 280/843 |
| 4,294,456 | 10/1981 | Tuell et al. | 280/11.28 |
| 4,394,037 | 7/1983 | Kuntz | 280/816 |
| 4,401,311 | 8/1983 | Almeraz | 280/843 |
| 4,618,158 | 10/1986 | Liberkowski | 280/843 |
| 4,838,564 | 6/1989 | Jarvis | 280/11.28 |
| 5,135,244 | 8/1992 | Allison | 280/11.28 |
| 5,199,727 | 4/1993 | Lai | 280/11.28 |
| 5,259,632 | 11/1993 | Mahoney | 280/7.14 |
| 5,411,320 | 5/1995 | Alderman et al. | 301/5.3 |
| 5,494,304 | 2/1996 | Levy et al. | 280/11.22 |
| 5,590,890 | 1/1997 | Rosso et al. | 280/11.22 |
| 5,685,550 | 11/1997 | Mayer, II | 280/11.2 |
| 5,899,465 | 5/1999 | Mayer, II | 280/11.2 |

*Primary Examiner*—Brian L. Johnson
*Assistant Examiner*—Bridget Avery
*Attorney, Agent, or Firm*—Guido Modiano; Albert Josif; Daniel O'Byrne

[57] ABSTRACT

A skate with single-rail truck, particularly with in-line wheels, comprising a rail-shaped frame which is associable with a shoe and supports a plurality of in-line wheels, each wheel being formed by half-bodies arranged on opposite sides of the rail-shaped frame. The skate further comprises two bearings, for the connection of each wheel to the rail-shaped frame, which are arranged on opposite sides of the frame, and means for coupling the half-bodies of each wheel to make them rotate rigidly together.

13 Claims, 2 Drawing Sheets

SKATE WITH SINGLE-BLADE TRUCK, PARTICULARLY WITH IN-LINE WHEELS

BACKGROUND OF THE INVENTION

The present invention relates to a skate with single-rail truck, particularly with in-line wheels.

Conventional skates with in-line wheels that are already commercially available have a plurality of wheels, generally three to five according to the kind of use, which are aligned and are supported by a frame, generally made of metal, that is connected to the lower part of a shoe which can be variously shaped.

The wheel supporting frame is typically shaped like an inverted U, with parallel side walls which are perpendicular to the ground and have holes, inside which the shafts for the pivoting of the respective wheels are fixed.

The typical drawback of these skates resides in the fact that the movements of the athlete, especially with reference to certain sports in which it is very often necessary to be able to tilt the skate beyond conventional angles, so that it is almost parallel to the ground, as occurs for example in hockey, are hindered because interference with the ground would occur.

Accurate tests have allowed to determine that the limitation of the angle of incidence with respect to the ground is caused not so much by the shoe but rather by the shape of the wheel and by the presence of the frame shaped like an inverted U, because this cross-section necessarily entails a considerable bulk which contributes to loss of wheel grip once a certain limit is exceeded.

In order to eliminate this drawback, in-line skates have already been marketed wherein the supporting frame is substantially rail-shaped, providing support for the axle of the wheels, which are advantageously provided by means of two wheel halves arranged on opposite sides with respect to the rail-shaped frame.

Embodiments of this type are disclosed for example in U.S. Pat. No. 2,166,766 and EP 0 127 734 patents.

In this embodiment, the pivot or axle for the rotation of the wheel is rigidly coupled to the rail-shaped structure of the frame and the wheels are connected to the pivot by means of two bearings, wherein the inner part is fixed with respect to the pivot and the outer part is fixed with respect to the wheels.

With this embodiment, the two wheel halves are independent from one another, so that during changes in direction, when the lateral inclination of the skate varies and therefore contact with the ground shifts from one wheel half to the other, poor reactivity of the skate inevitably occurs. The wheel half that makes contact with the ground, by being substantially motionless, in fact produces energy losses. This aspect is important especially in hockey, where quick and frequent changes in direction, with very tight curving radii and with the smallest possible energy loss, are required.

It should in fact be noted that when changing direction, the wheel half that begins to make contact with the ground would have a rotation rate of approximately zero and, in an infinitesimal time, would have to reach the value of the instantaneous rotation rate of the other wheel half; it is evident that the mass of the wheel does not start to move instantaneously, due to inertia, and therefore a significant energy loss occurs.

Other known solutions, such as for example those disclosed in U.S. Pat. No. 5,069,462 and U.S. Pat. No. 2,570,349 patents, provide for a wheel constituted by two mutually rigidly coupled half-shells, and therefore the rotation rate would not be different even during direction changes; however, in these solutions the wheel is supported by a single bearing contained within the thickness of the single-rail truck.

Supporting the wheel halves by means of a single central bearing inevitably entails considerable instability on the wheel halves, with consequent vibrations which make it difficult to control the skate; this occurs due to the intense stresses discharged onto the bearing, particularly those acting along directions other than the vertical with respect to the ground; the stress to which the bearing is subjected therefore rapidly produces wear and plays among the various components, leading to the above-mentioned instability due to loss of coupling precision.

SUMMARY OF THE INVENTION

A principal aim of the invention is to eliminate the above-mentioned drawbacks by providing a skate with single-rail truck in which it is possible to have wheels obtained from half-shells or half-bodies that are dynamically rigidly linked to each other, while nonetheless having optimum support with respect to the rail of the truck.

Within the scope of this aim, a particular object of the invention is to provide a skate wherein the pivot rotates rigidly with the wheels, with a consequent higher rim speed of the wheels due to the obtainable increase in angular velocity and to the lower friction and higher moment of inertia.

Another object of the present invention is to provide a skate with single-rail truck, particularly with in-line wheels, which by virtue of its particular constructive characteristics is capable of giving the greatest assurances of reliability and safety in use.

Another object of the present invention is to provide a skate with single-rail truck that can be easily obtained starting from commonly commercially available elements and materials and is furthermore competitive from a merely economical point of view.

This aim, these objects, and others which will become apparent hereinafter are achieved by a skate with single-rail truck, particularly with in-line wheels, according to the invention, comprising a rail-shaped frame which is associable with a shoe and supports a plurality of in-line wheels, each wheel being formed by half-bodies arranged on opposite sides of said rail-shaped frame, characterized in that it comprises two bearings for the connection of each wheel to said rail-shaped frame, said bearings being arranged on opposite sides of said frame, and means for coupling said half-bodies of each wheel to make them rotate rigidly together.

BRIEF DESCRIPTION OF THE DRAWINGS

Further characteristics and advantages will become apparent from the following detailed description of a preferred but not exclusive embodiment of a skate with single-blade truck, particularly with in-line wheels, illustrated only by way of non-limitative example in the accompanying drawings, wherein.

DESCRIPTION OF THE PREFERRED EMBODIMENTS

Figure 1:
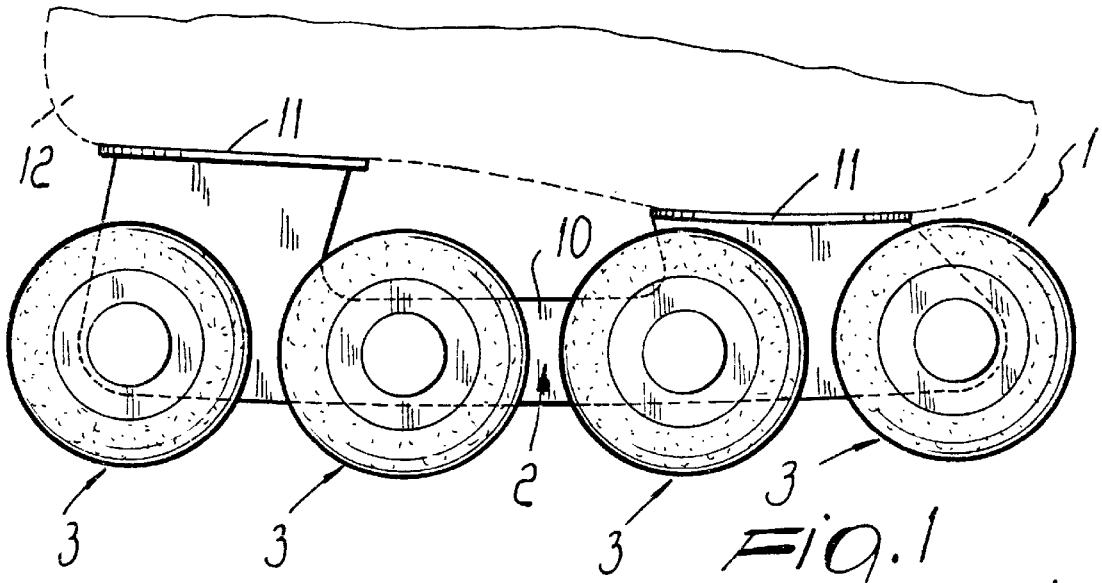
FIG. 1 is a schematic lateral elevation view of a skate, illustrating the single-rail truck provided with four in-line wheels.
Figure 2:
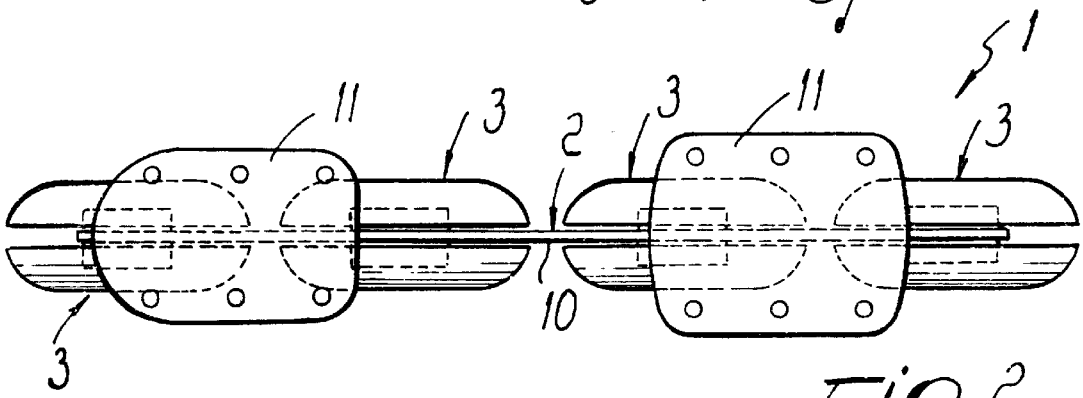
FIG. 2 is a plan view of the truck.
Figure 3:
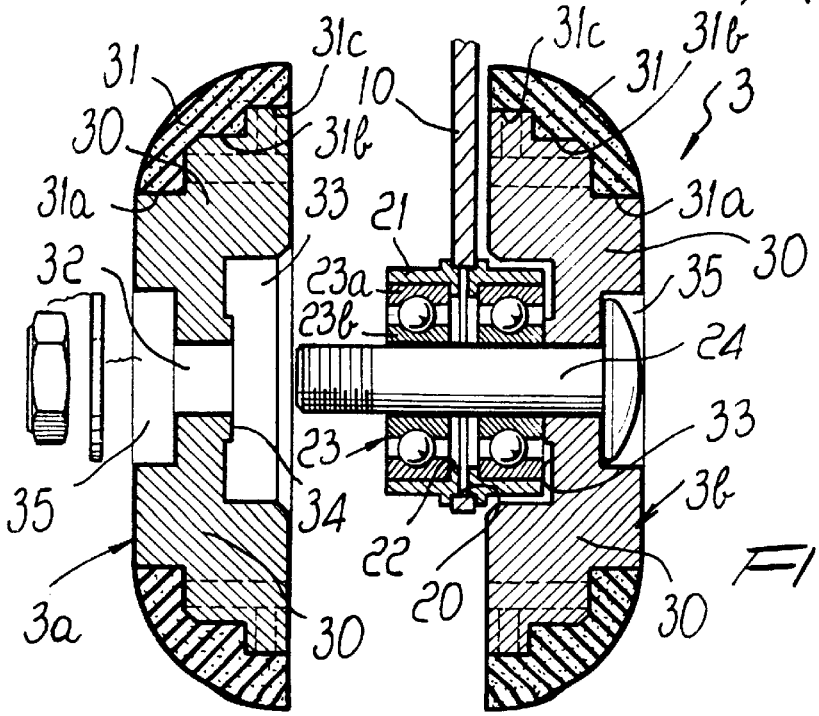
FIG. 3 is a sectional exploded view of a wheel.

With reference to the above figures, the skate with in-line wheels, according to the invention, generally designated by the reference numeral 1, comprises a single- or rail frame 2, made for example of Ergal aluminum or the like, to which wheels, generally designated by the reference numeral 3, are pivoted.

The wheels can optionally be provided with an eccentric system which can be adjusted so that the two central wheels are always mutually co-planar, whereas the wheels arranged at the ends are slightly raised with respect to the ideal plane affected by the two central wheels.

The frame 2, which is preferably monolithic, comprises a central rail 10 which is optionally provided with a recess at the center and has, at its ends, end soleplates 11 which can be fixed, in a per se known manner, to a shoe generally designated by the reference numeral 12.

Openings 20 for accommodating the wheels 3 are provided on the central portion 10 of the rail-shaped frame.

An important particularity of the invention is constituted by the fact that at each opening there are provided, on both sides of the central portion 10 of the rail, cylindrical shoulders 21 which can be formed monolithically with the rail or otherwise rigidly coupled.

Shoulders 21 form, at the internal perimeter, a central shoulder 22 which acts as an abutment tooth to delimit two separate seats to the side of the central rail 10.

Each individual seat internally accommodates a ball bearing 23, one for each side of the blade-shaped body, which acts as a support for the pivot 24 that joins the two half-bodies 3*a* and 3*b* to each other, which constitute the wheel 3.

The two half-bodies are joined to each other so that they rotate rigidly together and the bearings 23 are furthermore provided so that the outer portion or ring 23*a* is rigidly coupled to the cylindrical shoulders 21 and the inner portion or ring 23*b* rotates rigidly with the pivot 24.

The half-bodies 3*a* and 3*b*, which are rigidly coupled to the pivot, are preferably provided by means of an insert 30, made for example of nylon, to which a covering layer 31, made for example of polyurethane, is applied; said covering layer forms the ground contact portion of the wheels, which can be shaped in any manner, for example so as to provide a wide and substantially flat ground contact surface flanked by curved regions, constituting an involute surface.

The insert preferably forms circular regions 31*a*, 31*b*, and 31*c* which are at different levels, so as to obtain different thicknesses of the covering polyurethane in a radial direction.

The insert 30, which has an axial hole 32, is provided, around the hole 32 on the face directed towards the rail-shaped body, with a recess 33 for accommodating the shoulders 21 and with an abutment ridge 34 which engages the inner part 23*b* of the bearing.

In this manner, a correct play and a correct distance between the wheel insert and the shoulder 21 are achieved, since the fixed outer part of the bearings 23 abuts against the inner shoulder 22 and the rotating outer part abuts against the abutment ridge 34.

A hollow 35 is provided on the opposite side with respect to the recess 33, and the usual nuts for locking the heel pivot are inserted therein.

Figure 4:
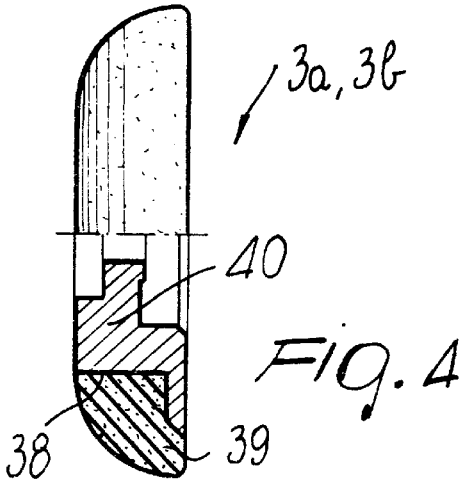
FIG. 4 is a sectional view of a half-wheel having a different shape.
Figure 5:
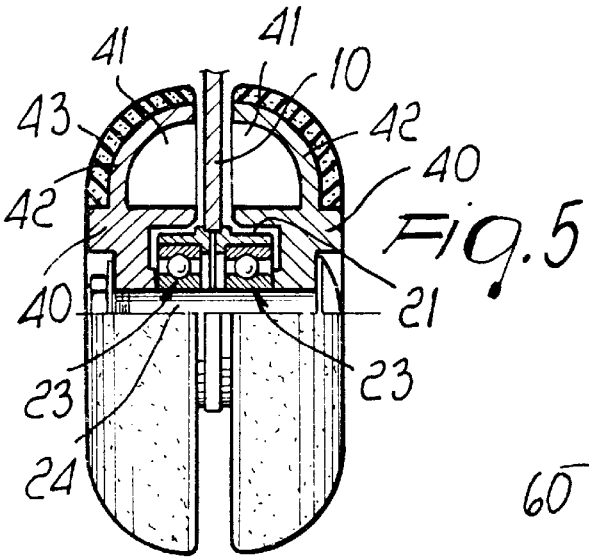
FIG. 5 is a partially sectional view of a wheel having a different configuration.

According to FIG. 4, the insert of the half-body has, on its outer portion, a substantially cylindrical shape 38 with a relatively large covering layer 39. With reference to FIG. 5, the insert, now designated by the reference numeral 40, has, at its peripheral region, a groove 41 which is directed towards the rail-shaped body 10 so as to form an annular edge shaped like a toroidal portion 42, which is covered by a covering layer 43; said edge 42 is flexible and yields outwards if substantially perpendicular forces act thereon.

With this embodiment, an effective shock-absorbing effect is obtained and, once the flexible edge 42 has been deformed, an elastic return element.

Figure 6:
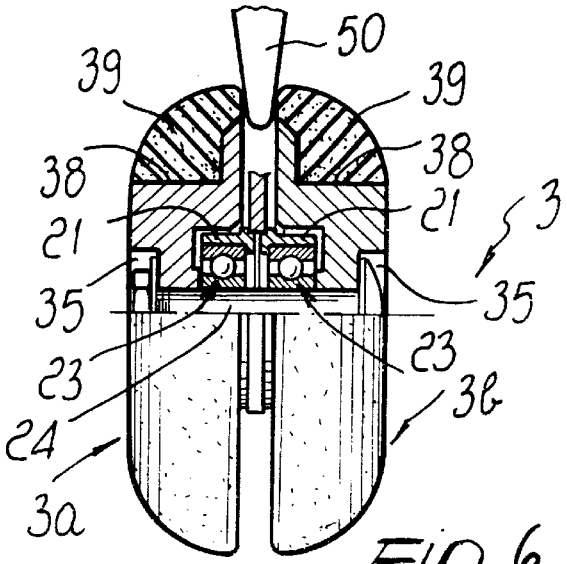
FIG. 6 is a schematic view of a braking device.

As shown in FIG. 6, it is possible to provide for a braking element constituted by a conical element 50 which fits between the two half-bodies, with a substantially radial movement, and is advantageously connected to a slider whereon a corresponding contrast spring, not shown, applies its action.

The conical element 50 is actuated by lifting the heel in the skate, with a braking effect caused by the insertion of the conical element 50 between the two mirror-symmetrical faces of the corresponding half-bodies.

Figure 7:
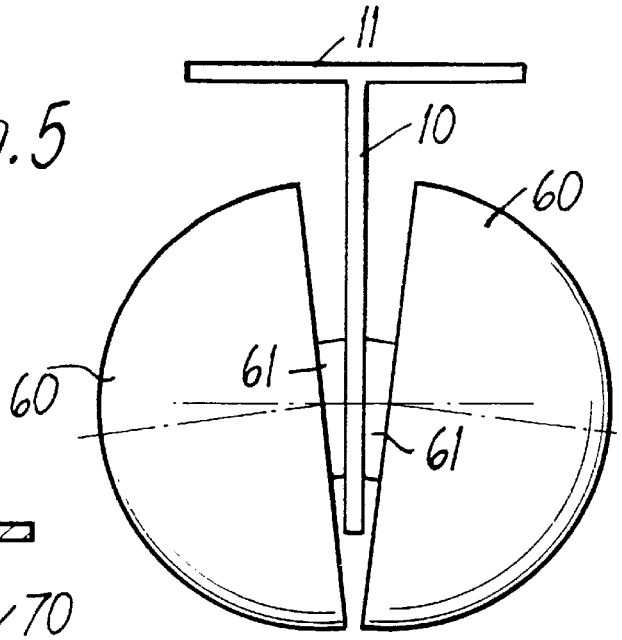
FIG. 7 is a view of a wheel with half-shells or halfbodies having mutually inclined axes.

According to FIG. 7, it is possible to provide halfbodies, designated by the reference numeral 60, which are connected to the rail-shaped body 10 along mutually inclined axes 61; in this manner, the two half-bodies can assume a particular cambered shape, thus forming a particularly wide ground contact area.

Figure 8:
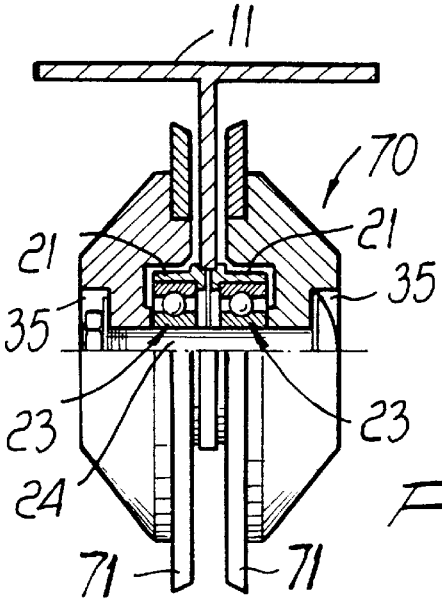
FIG. 8 is a schematic sectional view of a wheel with ice-skating blades.

According to FIG. 8, it is possible to provide a wheel, generally designated by the reference numeral 70, which structurally has the above-mentioned characteristics but which, instead of the covering element, has blade-shaped rings 71 which are supported by the insert and provide ground contact, thus allowing to provide a skate that can be used on ice.

It should be added that the rail-shaped body that supports the wheels may optionally not have the anchoring soleplates and may have simple holes in which through engagement means for coupling to a shoe pass.

In the above embodiments, the provided combination, in which there are wheels constituted by two half-bodies which are dynamically rigidly coupled to each other, making their operation resemble that of a single wheel having a central groove, is particular important.

This aspect is particularly advantageous for skate reactivity during direction changes, since when the lateral inclination of the skate varies, the half-wheel that makes contact with the ground is already rotating at an instantaneous velocity the value whereof is equal to the value of the half-wheel that is no longer in contact, and therefore no energy losses occur.

Moreover, use of two bearings 23, which are supported inside the shoulder 21, allows to keep the outer part of the bearing rigidly coupled to the rail-shaped frame, while the hub or rotation pivot of the two half-shells is rigidly coupled to the inner part.

The advantage of this solution is that the outer ring of the bearings is fixed, whereas the inner ring rotates; accordingly, the pivot rotates rigidly with the wheels, with a consequent higher rim velocity of said wheels due to the obtainable increase in angular velocity, with lower friction and with a higher moment of inertia.

In this embodiment, the provision of two bearings arranged on opposite sides with respect to the central rail is essential, since all the problems of vibration and wear that instead occurred in the solutions in which a single bearing accommodated in the thickness of the single-rail frame was provided, are eliminated.

From the above description, it is thus evident that the invention achieves the intended aim and objects; in particular, the fact is stressed that the new solution, by obtaining a skate with in-line wheels formed by two half-shells which are dynamically rigidly coupled to each other and are supported by bearings arranged laterally to the single-rail frame, with the outer portion of the bearing rigidly coupled to the frame and the inner portion rigidly coupled to the pivot, allows to obtain particularly high-level performance results which cannot be found in conventional solutions.

The invention thus conceived is susceptible of numerous modifications and variations, all of which are within the scope of the inventive concept.

All the details may furthermore be replaced with other technically equivalent elements.

In practice, the materials employed, so long as they are compatible with the specific use, as well as the contingent shapes and the dimensions, may be any according to requirements.

What is claimed is:

1. A skate with a single-rail truck with in-line wheels, comprising a rail-shaped frame which is associable with a shoe and supports a plurality of in-line wheels, each wheel being formed by half-bodies arranged on opposite sides of said rail-shaped frame, further comprising two bearings for the connection of each wheel to said rail-shaped frame, said bearings being arranged on opposite sides of said frame, and means for coupling said half-bodies of each wheel to make said half-bodies of each wheel rotate rigidly together, the skate further comprising, at openings formed on said central rail for the connection of the wheels, cylindrical shoulders which are rigidly coupled to said central rail and protrude at the opposite sides of said central rail, each of said shoulders forming seats for accommodating said two bearings, and each one of said bearings having an outer ring or portion, which is rapidly coupled to a respective one of said cylindrical shoulders, and an inner ring or portion, which is rigidly coupled to a respective pivot which joins said half-bodies to one another, whereby said outer ring or portion is fixed relative to said central rail and said inner rings or portion rotates together with said pivot relative to said central rail inside one of said openings of said central rail.

2. A skate with a single-rail truck according to claim 1, wherein said rail-shaped frame comprises a central rail which has, at ends of said central rail, end soleplates which lie on a plane that is perpendicular to the plane of arrangement of said central rail and can be coupled to a sole of the shoe.

3. A skate with a single-rail truck according to claim 1, wherein said cylindrical shoulders are formed monolithically with said central rail.

4. A skate with a single-rail truck according to claim 1, wherein said cylindrical shoulders have, at inner perimeters thereof, a central shoulder to provide a positioning abutment for said two bearings.

5. A skate with a single-rail truck according to claim 1, wherein each one of said half-bodies has an insert whereon a covering layer is applied, said layer forming the ground contact portion of the wheel.

6. A skate with a single-rail truck according to claim 1, further comprising a braking element constituted by a conical element which can be inserted between the two half-bodies.

7. A skate with a single-rail truck according to claim 1, wherein said half-bodies have axes which are mutually inclined and arranged symmetrically with respect to the plane of arrangement of said single-rail frame.

8. A skate with a single-rail truck according to claim 1, further comprising blade-shaped rings at the peripheral region of each half-body in order to provide a skate which can be used on ice.

9. A skate with a single-rail truck according to claim 1, wherein each said half-body of said half-bodies of each wheel has, on the face directed towards said central rail, proximate to the peripheral region, a groove which provides for an annular edge shaped like a toroidal portion on which a covering layer is provided, said annular edge shaped like a toroidal portion being flexible.

10. A skate with a single-rail truck according to claim 4, wherein each one of said half-bodies has, on the face directed towards said central rail, a recess for accommodating said shoulders, said recess being centrally delimited by an abutment ridge which can engage the inner portion of said bearing.

11. A skate with a single-rail truck according to claim 5, wherein said insert has, at different levels, circular regions whereon for applying different thicknesses of covering layer.

12. A skate with a single-rail truck according to claim 10, wherein said half-body has, on the opposite side with respect to said recess, a hollow for the insertion of means for locking said wheel pivot.

13. A skate with a single-rail truck with in-line wheels, comprising:

a rail-shaped frame connectable with a shoe;

a plurality of in-line wheels rotatably supported by said rail-shaped frame, each wheel being formed by half-bodies arranged on opposite sides of said rail-shaped frame;

two bearings for the connection of each wheel of said wheels to said rail-shaped frame, said bearings being arranged on opposite sides of said frame, an opening for each wheel formed on said central rail for the connection of said each wheel;

cylindrical shoulders formed at said opening of said central rail and protruding at the opposite sides of said central rail, each of said shoulders forming a seat for accommodating a respective one of said two bearings;

a pivot for each wheel to which each of said half-bodies is joined to make said half-bodies of each wheel rotate rigidly together;

each one of said bearings having an outer portion, which is rigidly coupled to a respective one of said cylindrical shoulders, and an inner portion, which is rigidly coupled to said pivot which joins said half-bodies to one another, whereby said outer ring or portion is fixed relative to said central rail and said inner ring or portion rotates together with said pivot relative to said central rail inside said opening of said central rail.

* * * * *